US008401202B2

(12) United States Patent
Brooking

(10) Patent No.: US 8,401,202 B2
(45) Date of Patent: Mar. 19, 2013

(54) SPEAKERS WITH A DIGITAL SIGNAL PROCESSOR

(75) Inventor: Eric Blackwell Brooking, San Diego, CA (US)

(73) Assignee: KSC Industries Incorporated, Chula Vista, CA (US)

( * ) Notice: Subject to any disclaimer, the term of this patent is extended or adjusted under 35 U.S.C. 154(b) by 1371 days.

(21) Appl. No.: 12/053,505

(22) Filed: Mar. 21, 2008

(65) Prior Publication Data

US 2009/0225996 A1 Sep. 10, 2009

Related U.S. Application Data

(60) Provisional application No. 61/034,937, filed on Mar. 7, 2008.

(51) Int. Cl.
*H04R 29/00* (2006.01)

(52) U.S. Cl. ..... 381/59; 381/86

(58) Field of Classification Search ..... 381/59, 381/98, 103
See application file for complete search history.

(56) References Cited

U.S. PATENT DOCUMENTS

| | | | | |
|---|---|---|---|---|
| 4,610,024 | A | 9/1986 | Schulhof | |
| 4,852,176 | A | 7/1989 | Truhe | |
| 5,406,634 | A | 4/1995 | Anderson et al. | |
| 5,430,802 | A | 7/1995 | Page | |
| 5,511,129 | A * | 4/1996 | Craven et al. | 381/103 |
| 6,674,864 | B1 | 1/2004 | Kitamura | |
| 6,697,492 | B1 | 2/2004 | Yamaguchi et al. | |
| 6,731,760 | B2 * | 5/2004 | Pedersen | 381/59 |
| 6,766,025 | B1 | 7/2004 | Levy et al. | |
| 6,859,538 | B1 | 2/2005 | Voltz | |
| 6,996,240 | B1 | 2/2006 | Sasaki | |
| 7,031,476 | B1 | 4/2006 | Chrisop et al. | |
| 2004/0141623 | A1 * | 7/2004 | Kushida | 381/61 |
| 2007/0030979 | A1 * | 2/2007 | Nackvi et al. | 381/59 |
| 2009/0316930 | A1 * | 12/2009 | Horbach et al. | 381/99 |
| 2010/0272270 | A1 * | 10/2010 | Chaikin et al. | 381/59 |

FOREIGN PATENT DOCUMENTS

| | | |
|---|---|---|
| WO | WO 97/25833 | 7/1997 |

OTHER PUBLICATIONS

ALTEC Lansing, description of 604E Super Duplex Loudspeaker, California.

United Recording Electronics Industries, Time Aligned Studio Monitor System Model 813A, California, 1981.

* cited by examiner

*Primary Examiner* — Minh-Loan T Tran
*Assistant Examiner* — Fazli Erdem
(74) *Attorney, Agent, or Firm* — Knobbe Martens Olson & Bear LLP

(57) ABSTRACT

A speaker with a digital signal processor is disclosed. In one aspect, a speaker comprises at least one electromechanical transducer configured to convert an electrical audio signal into sound and a digital signal processor configured to process an audio signal and send the processed audio signal to the electromechanical transducer directly or indirectly.

24 Claims, 6 Drawing Sheets

SPEAKERS WITH A DIGITAL SIGNAL PROCESSOR

CROSS REFERENCE TO RELATED APPLICATION

This application claims priority under 35 U.S.C. §119(e) to U.S. provisional patent application 61/034,937 titled "Speakers with a Digital Signal Processor" filed on Mar. 7, 2008, which is hereby incorporated by reference in its entirety.

BACKGROUND OF THE INVENTION

1. Field of the Invention

The invention relates to speakers. More particularly, the invention relates to a speaker having a digital signal processor.

2. Description of the Related Technology

Today's speakers face many issues which may prevent a speaker from delivering a real image of what is recorded. For example, a speaker may include separate and vertically mounted high-frequency and low-frequency drivers. Such a speaker suffers in the near field monitoring position from what is called "point source confusion". With instruments that produce energy in the frequency range of both the high-frequency and low-frequency drivers, a listener in the near field has a tendency to look up and down repeatedly between the high-frequency and low-frequency drivers as the listener searches for the true source of the sound. This searching is caused by the high-frequency driver and the low-frequency driver both playing a portion of the sound from the instruments. This destroys the image in the near field. There are other issues such as secondary reflections, room anomaly, manufacturing variations which also impair a speaker's performance. Therefore, it is desirable to design a speaker which overcomes these issues and delivers an image closer to what is recorded.

SUMMARY

The system, method, and devices of the invention each have several aspects, no single one of which is solely responsible for its desirable attributes. Without limiting the scope of this invention, its more prominent features will now be briefly discussed.

In one aspect, a speaker is disclosed. The speaker comprises at least one electromechanical transducer configured to convert an electrical audio signal into sound. The speaker further comprises a digital signal processor configured to process an audio signal and send the processed audio signal to the electromechanical transducer directly or indirectly.

In another aspect, a speaker is disclosed. The speaker comprises means for converting an audio signal into acoustic waves. The speaker further comprises means for digitally processing the audio signals and sending the processed audio signal to the converting means for converting directly or indirectly.

In another aspect, a method of configuring a speaker to compensate for room anomalies is disclosed. The speaker comprises a digital signal processor which comprises tunable room anomaly correction filters. The method further comprises generating room anomaly correction coefficients to optimize the speaker response for a particular listening position in the room. The method further comprises saving the generated coefficients into the digital signal processor to configure the room anomaly correction filters.

In another aspect, a device for configuring a speaker to compensate for room anomalies is disclosed, wherein the speaker comprises a digital signal processor which comprises tunable room anomaly correction filters. The device comprises a storage unit having stored therein a software module. The device further comprises a control unit configured to perform a software module. The software module is configured to a) generate room anomaly correction coefficients to optimize the speaker response for a particular listening position in the room; and b) save the generated coefficients into the digital signal processor to configure the room anomaly correction filters.

In another aspect, a method of configuring a speaker to compensate for secondary reflections, which are reflections off an object in a room, is disclosed, wherein the speaker comprises a digital signal processor which comprises tunable secondary reflection correction filters. The method comprises identifying secondary reflections, generating secondary reflection correction coefficients to cancel secondary reflections arriving within a particular time limit, and saving the generated coefficients into the digital signal processor to configure the secondary reflection correction filters.

In another aspect, a device for configuring a speaker to compensate for secondary reflections, which are reflections off an object in a room, is disclosed, wherein the speaker comprises a digital signal processor which comprises tunable secondary reflection correction filters. The device comprises a storage unit having stored therein a software module and a control unit configured to perform a software module. The software module is configured to a) identify secondary reflections, b) generate secondary reflection correction coefficients to cancel secondary reflections arriving within a particular time limit; and c) save the generated coefficients into the digital signal processor to configure the secondary reflection correction filters.

In another aspect, a method of testing a speaker is disclosed. The method comprises sending a test audio signal to the speaker and measuring the acoustic response of the speaker, and storing a profile associated with the speaker into a database, the profile comprising information related to the speaker's acoustic response.

In another aspect, a device for testing a speaker is disclosed. The device comprises a storage unit having stored therein a software module, and a control unit configured to perform the software module. The software module is configured to a) send a test audio signal to the speaker and measuring the acoustic response of the speaker, and b) store a profile associated with the speaker into a database, the profile comprising information related to the speaker's acoustic response.

In another aspect, a method of configuring a speaker is disclosed. The method comprises retrieving a profile associated with the speaker from a database, the profile comprising information related to the speaker's acoustic response; and configuring the speaker based on the retrieved profile.

In another aspect, a device for configuring a speaker is disclosed. The device comprises a storage unit having stored therein a software module, and a control unit configured to perform the software module. The software module is configured to a) retrieve a profile associated with the speaker from a database, the profile comprising information related to the speaker's acoustic response; and b) configure the speaker based on the retrieved profile.

In another aspect, a method of configuring a speaker is disclosed. The method comprises measuring and saving the acoustic response of a speaker at a first location. The method further comprises delivering the saved acoustic response to a second location. The method further comprises configuring the speaker based on the saved acoustic response at the second location.

In another aspect, a device for configuring a speaker to compensate for room anomalies is disclosed. The speaker comprises a digital signal processor which comprises tunable room anomaly correction filters. The device comprises means for generating room anomaly correction coefficients to optimize the speaker response for a particular listening position in the room, and means for saving the generated coefficients into the digital signal processor to configure the room anomaly correction filters.

In another aspect, a device for configuring a speaker to compensate for secondary reflections, which are reflections off an object in a room, is disclosed. The speaker comprises a digital signal processor which comprises tunable secondary reflection correction filters. The device comprises means for identifying secondary reflections, means for generating secondary reflection correction coefficients to cancel secondary reflections arriving within a particular time limit, and means for saving the generated coefficients into the digital signal processor to configure the secondary reflection correction filters.

In another aspect, a device for testing a speaker is disclosed. The device comprises means for sending a test audio signal to the speaker and measuring the acoustic response of the speaker, and means for storing a profile associated with the speaker into a database, the profile comprising information related to the speaker's acoustic response.

In another aspect, a device for configuring a speaker is disclosed. The device comprises means for retrieving a profile associated with the speaker from a database, the profile comprising information related to the speaker's acoustic response; and means for configuring the speaker based on the retrieved profile.

DETAILED DESCRIPTION OF CERTAIN INVENTIVE EMBODIMENTS

Figure 1:
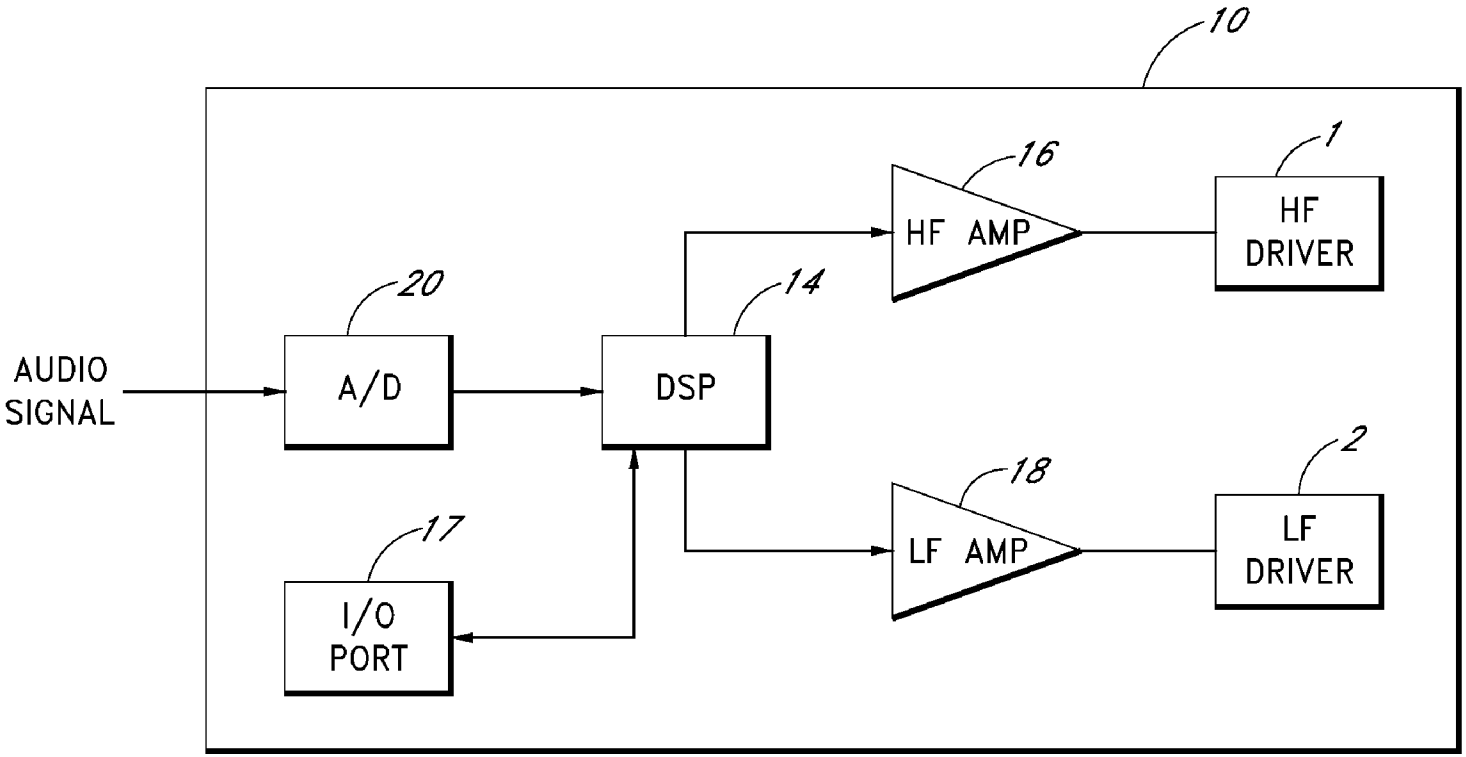
FIG. 1 is a block diagram of a speaker that includes a digital signal processor in accordance with a preferred embodiment of the present invention.

Various aspects and features of the invention will become more fully apparent from the following description and appended claims taken in conjunction with the foregoing drawings. In the drawings, like reference numerals indicate identical or functionally similar elements. In the following description, specific details are given to provide a thorough understanding of the disclosed methods and apparatus. However, it will be understood by one of ordinary skill in the technology that the disclosed systems and methods may be practiced without these specific details. For example, electrical components may be shown in block diagrams in order not to obscure certain aspects in unnecessary detail. In other instances, such components, other structures and techniques may be shown in detail to further explain certain aspects.

It is also noted that certain aspects may be described as a process, which is depicted as a flowchart, a flow diagram, a structure diagram, or a block diagram. Although a flowchart may describe the operations as a sequential process, many of the operations may be performed in parallel or concurrently and the process may be repeated. In addition, the order of the operations may be re-arranged. A process is terminated when its operations are completed. A process may correspond to a method, a function, a procedure, a subroutine, a subprogram, etc. When a process corresponds to a function, its termination corresponds to a return of the function to the calling function or the main function.

Certain embodiments as will be described below relate generally to a speaker comprising a digital signal processor. These embodiments provide solutions to various issues preventing a speaker from delivering a real and accurate image of what is recorded.

FIG. 1 is a block diagram illustrating one embodiment of a speaker 10 integrated with a digital signal processor 14. The speaker 10 may comprise any number of drivers, which refer to electromechanical transducers that convert an electrical signal into sound. In the exemplary embodiment, the speaker 10 comprises two drivers to cover different frequency ranges, i.e., a high-frequency driver 1 (e.g., a tweeter) generally providing low- to mid-range frequencies and a low-frequency driver 2 (e.g., a woofer) generally providing mid- to high-range frequencies. There is typically an overlap between the frequency range covered by the high-frequency driver 1 and the frequency range covered by the low-frequency driver 2.

The speaker 10 may comprise an analog/digital (A/D) converter 20 configured to convert incoming analog audio signals into digital audio signals. Such an A/D converter 20 is not needed if the incoming audio signals are digital.

The digital signal processor (DSP) 14 processes digital audio signals, either from the A/D converter 20 or from the speaker audio input. Depending upon the number of drivers, the DSP 14 divides the signals into individual frequency ranges, i.e., the high-frequency and low-frequency ranges. The digital signal processor 14 may also be any suitable digital control device such as a processor which may be any suitable general purpose single- or multi-chip microprocessor, or any suitable special purpose microprocessor such as microcontroller, or a programmable gate array. As is conventional, the digital signal processor 14 may be configured to execute one or more software applications.

In one embodiment, the DSP 14 comprises a control unit and a storage unit. The control unit is configured to control the operation of the DSP 14 and execute software modules. The storage unit is configured to store any data or software modules.

The speaker 10 may comprise a high-frequency amplifier 16 and a low-frequency amplifier 18 configured to amplify audio signals from the DSP 14 and feed to the high-frequency driver 1 and low-frequency driver 2, respectively. The amplifiers 16 and 18 may be integrated with the DSP 14.

The speaker 10 may further comprise an input/output (I/O) port 17 connected to the DSP 14. The DSP 14 may use the I/O port 17 to communicate with outside devices to send/receive control data or instructions. In one embodiment, the I/O port 17 provides a universal serial bus (USB) connection, or a network connection.

Figure 2:
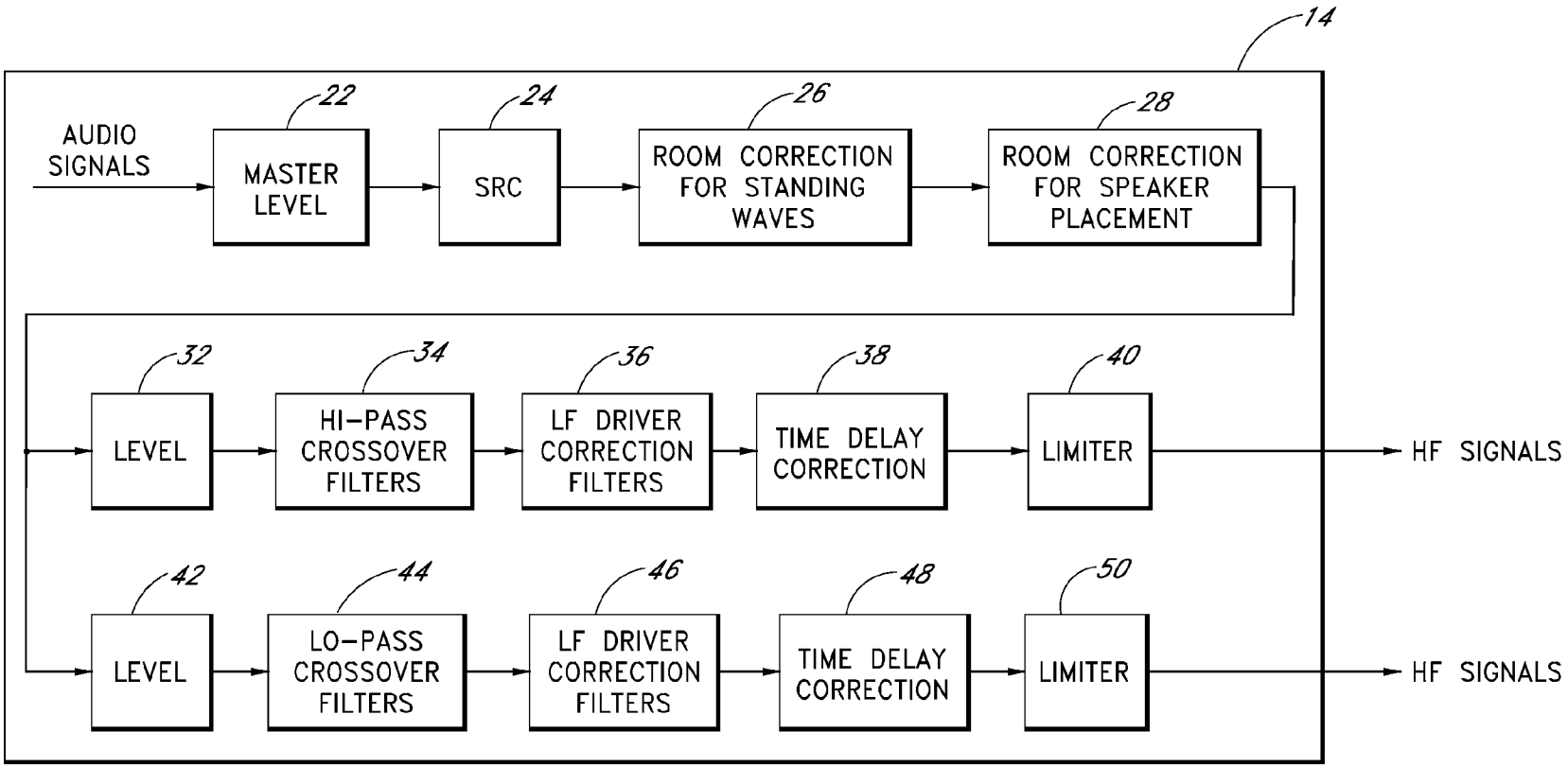
FIG. 2 is a functional block diagram illustrating one embodiment of the digital signal processor from FIG. 1.

FIG. 2 is a functional block diagram illustrating one embodiment of the digital signal processor in a speaker. The DSP 14 may comprises a master level unit 22 configured to receive audio signals, set input sensitivity, and correct for overall level differences.

The DSP 14 may further comprise a secondary reflection correction unit (SRC) 24 configured to process the audio signals at its input to compensate for secondary reflections. In one embodiment, the secondary reflection correction unit 24 comprises one or more finite impulse response filters. The finite impulse response filters cancel early reflections off an object, e.g., those within about a few milliseconds, with inverted band-limited impulses. Further detail on the secondary reflection corrections will be described later with regard to FIG. 6.

The DSP 14 may further comprise a standing waves room correction module 26 configured to perform room correction for standing waves. In one embodiment, the standing waves room correction module 26 comprises a bank of N infinite impulse response (IIR) bi-quad filters. N infinite impulse response (IIR) bi-quad filters are second order (two poles and two zeros) infinite impulse response (IIR) filters that correct for room modes standing waves.

The DSP 14 may further comprises a speaker placement room correction module 28 configured to perform room correction for speaker placement. In one embodiment, the speaker placement room correction module 28 comprises one or more parametric shelving filter to correct for boundary gain of bass frequencies caused by proximity of a speaker to walls, floor and/or ceiling. Further details on room correction and the modules 26 and 28 will be described later with regard to FIGS. 3-5.

The DSP 14 may further comprise a high-frequency level module 32 and a low-frequency level module 42, which are configured to adjust the levels of the high-frequency signal and low-frequency signals to compensate for possible differences in the efficiency of the high-frequency driver 1 and the low-frequency driver 2 (shown in FIG. 1).

The DSP 14 may further comprise hi-pass crossover filters 34 and low-pass crossover filters 44. The hi-pass crossover filters 34 are configured to pass high-frequency signals, i.e., signals to be supplied to the high-frequency driver 1. The low-pass crossover filters 44 are configured to pass low-frequency signals, i.e., signals to be supplied to the low-frequency driver 2. The hi-pass crossover filters 34 comprises a bank of N bi-quad IIR filters (in series or parallel), or any suitable high pass filters. The Low-pass crossover filters 44 comprises a bank of N bi-quad IIR filters (in series or parallel), or any suitable low pass filters.

The DSP 14 may further comprise a set of driver correction filters for each driver in the speaker 10, which are configured to correct the transfer function of that driver. In the exemplary embodiment, the DSP 14 comprises high-frequency driver correction filters 36 and low-frequency correction filters 46 configured to correct the transfer function of the high-frequency driver 1 and the low-frequency driver 2 respectively. The high-frequency driver correction filters 36 and the low-frequency correction filters 46 may each comprise a bank of N bi-quad IIR filters (in series or parallel), or any other suitable filter types.

The DSP 14 may further comprise a high-frequency time delay correction unit 38 and a low-frequency time delay correction unit 48 configured to work with other filters to introduce appropriate time delay so that sound from the high-frequency driver 1 and the low-frequency driver 2 arrives at a listener at the same time. In one embodiment, the time delay introduced is independent of the frequency of the signal. Also, the high-frequency time delay correction unit 38 and the low-frequency time delay correction unit 48 may be further configured to correct different path lengths for alternate listening positions.

The DSP 14 may further one limiter for each driver. In the exemplary embodiment, a high frequency limiter 40 and a low-frequency limiter 50 are configured to protect the high-frequency driver 1 and the low-frequency driver 2 respectively from excessive power and to limit audible distortion. This enables a multi-band limiter effect that minimizes the sonic impact of a limiter functioning. The limiter on the low frequency driver 2 has a side chain process which engages the limiter at different thresholds for different frequencies. This also decreases the sonic impact or degradation of fidelity when using the speakers at high levels.

Each of the blocks 22, 24, 26, 28, 32, 34, 36, 38, 40, 42, 44, 46, 48, and 50 may comprise tunable parameters which can be tuned in a setup process to optimize their performance. The tunable parameters may be, for example, coefficients for blocks which comprise filters.

Depending on the embodiment, certain blocks may be removed, merged together, or rearranged in order. These blocks may be implemented in various ways. In the exemplary embodiment, these blocks are implemented as software modules which may be stored in the storage unit of the DSP 14 and carried out by the control unit of the DSP. The tunable parameters of these blocks may be stored in the storage unit of the DSP 14.

Room Anomaly Correction

As mentioned above, the DSP 14 may comprise a standing waves room correction module 26 and a speaker placement room correction module 28 to compensate for room response anomalies. The standing waves room correction module 26 and the speaker placement room correction module 28 each comprises filters with tunable parameters which may be configured during a setup.

Room response anomalies will be described below after introduction of some facts of acoustics and how a listener processes information which can be utilized to provide superior performance from speakers. A listener can distinguish between the direct, first arrival waves and the reflected waves, given the wavelengths of sound are short enough (which means the frequencies of the sound are high enough) compared to the difference between paths of the direct vs. the reflected. The direct waves determine what the instrument sounds like while the reflected waves determine what the reverberant environment sounds like, as long as the wavelengths are short enough. For sound of frequencies low enough, a listener can not separate the direct from the reflected waves. In order to preserve the integrity of the direct wave of an instrument, so that a listener hears the "real" instrument recorded, the speaker needs to correct the room for those lower frequencies while maintaining an anechoic flat response for the higher frequencies One type of lower frequency room problem is called room modes. Room modes are the frequencies that can build up in a room. Room modes are caused by the reflection from wall to wall or ceiling to floor of the room. They are related to the distance between these flat surfaces. As a person walks across the room he can hear the energy build up at points and drop off at others. At those frequencies where this occurs, the peaks and dips don't move, which are often called standing waves. Most rooms have nine standing wave frequencies including three axial standing wave frequencies, three tangential standing waves frequencies, and three oblique standing wave frequencies. It should be noted that some of the nine frequencies may be at the same frequency, thus resulting in larger amplitude for that frequency.

In the exemplary embodiment, the standing waves room correction module 26 comprises a bank of N infinite impulse response (IIR) bi-quad filters to correct for room modes standing waves. In one embodiment, these N infinite impulse response bi-quad filters are able to correct at least the three frequencies out of the nine standing wave frequencies which have larger amplitude than the rest of the nine standing wave frequencies.

In one embodiment, the standing waves room correction module 26 compensates only the peaks, but not the holes. In one embodiment, the standing waves room correction module 26 is capable of correcting for two or more different positions in the room. In one embodiment, the standing waves room correction module 26 also take care of the difference in distances of the speaker to any desired listening position as well as any level differences.

In addition, there are also boundary effects and bass loading effects due to the placement and proximity of the speaker relative to walls and or ceiling and floor. The speaker placement room correction module 28 is configured to perform room correction for speaker placement. In one embodiment, the speaker placement room correction module 28 comprises parametric shelving filter to correct for boundary gain of bass frequencies caused by proximity of a speaker to walls, floor and/or ceiling.

Figure 3:
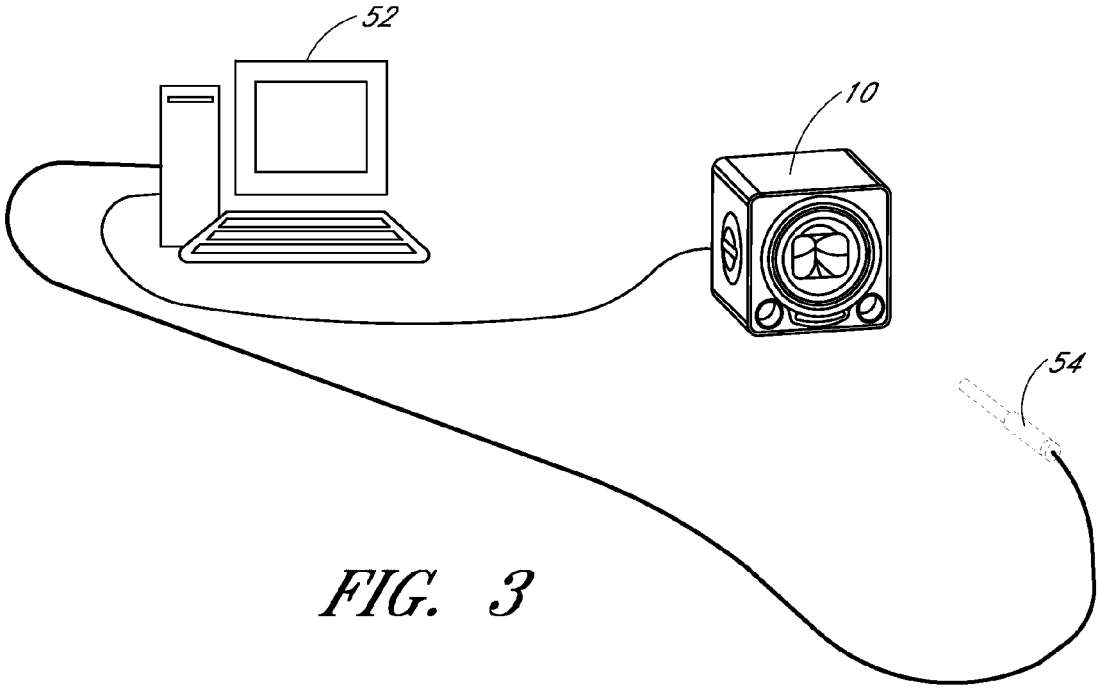
FIG. 3 is a diagram showing one embodiment of a system used to configure the DSP in the speaker and that includes a computer.

FIG. 3 is a diagram showing one embodiment of a system to configure the DSP in a speaker. A configuration device 52 is connected to one or more speakers 10 in a room. The configuration device 52 may be connected to the speaker 10 via, for example, the I/O port 17 of the speaker 10. The configuration device 52 is configured to send testing audio signals to the speaker 10 for playing.

In one embodiment, the configuration device 52 is also connected to a microphone 54, which receives the acoustic waves from the speaker 10 and sends a corresponding signal to the configuration device 52.

The configuration device 52 may comprise a control unit and a storage unit. The control unit may be any general-purpose or single-purpose digital signal processor which is capable of running a software module stored in the storage unit. In the exemplary embodiment, the configuration device 52 is a computer. The configuration device 52 also comprises an input/output port configured to communicate with devices such as the microphone 54 and the speaker 10.

In one embodiment, a mixer (not shown) may be added between the speaker 10 and the configuration device 52 to amplify the audio signals from the configuration device 52 before sending the signals to the speaker 10.

Depending on the software module running on the configuration device 52, this setup may be used to configure the DSP 14 for various purposes, including configuring the DSP 14 for room anomaly correction, secondary reflection correction, and manufacturing anomaly correction. In one embodiment, the configuration device 52 sends testing signals to the speaker 10 and detects the acoustic waves from the speaker 10 via the microphone 54. The configuration device 52 then determines, based on the detected response from the speaker 10, the optimal values for at least one tunable parameter in the DSP 14. The determined value for the tunable parameter is then saved into the storage unit of the DSP 14 and used thereafter by the DSP 14.

When the exemplary embodiment is used for room anomaly correction setup, the configuration device 52 runs a software module configured to test the room anomalies by send testing signals to the speaker 10 and detect the acoustic waves from the speaker 10 via the microphone 54. The software module then determines, based on the detected response from the speaker 10, the optimal coefficients for filters in the standing wave room correction module 26 and speaker placement room correction module 28. The determined coefficients are then saved into the storage unit of the DSP 14.

In the exemplary embodiment as described above, the configuration device 52 sends testing signals to the speaker 10 and detects the acoustic waves from the speaker 10 via the microphone 54. The configuration device 52 then determines, based on the detected response from the speaker 10, the optimal values for at least one tunable parameter in the DSP 14. However, the speaker configuration may also be performed without use of the microphone 54 in certain applications such as room anomaly correction and secondary reflection correction. In another embodiment, the configuration device 52 receives from a user via an input/output interface, various information such as information indicative of one of more of the following: room dimensions, speaker placement, and measurement of the direct and reflected path lengths. The configuration device 52 then determines, based on the information received, the optimal values for at least one tunable parameter in the DSP 14.

Figure 4:
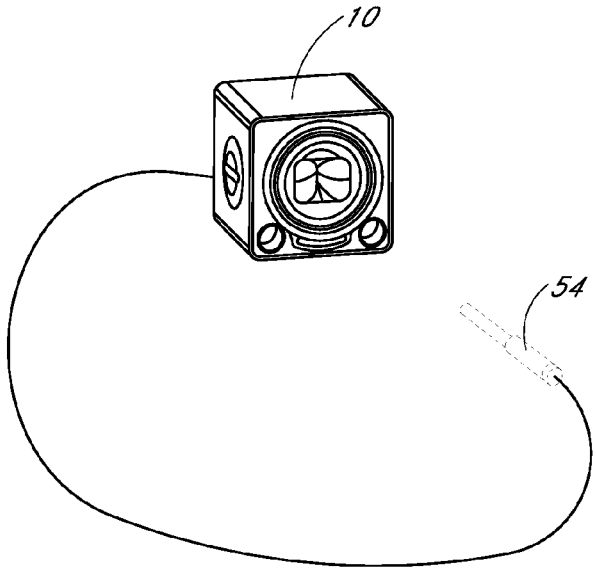
FIG. 4 is a diagram showing another embodiment of a system to configure the speaker.

FIG. 4 is a diagram showing another embodiment of a system to configure the speaker. The embodiment in FIG. 4 is similar to FIG. 3, except that the functions performed by the configuration device 52 in FIG. 3 are performed by the DSP 14 in FIG. 4.

The system comprises a speaker 10 connected to a microphone 54. Depending on the software module running on the DSP 14 of the speaker 10, this setup may be used to configure the DSP 14 for various purposes, including configuring the DSP 14 for room anomaly correction, secondary reflection correction, and manufacturing anomaly correction. Typically, the DSP 14 sends testing signals to drivers of the speaker 10 for playing and detects the acoustic waves from drivers of the speaker 10 via the microphone 54. The DSP 14 then determines, based on the detected response from the speaker 10, the optimal values for at least one tunable parameter in the DSP 14. The determined value for the tunable parameter is then saved into the storage unit of the DSP 14 and used thereafter by the DSP 14.

When the exemplary embodiment is used for room anomaly correction setup, the DSP 14 of the speaker 10 is configured to run a software module configured to send testing signals to the drivers of the speaker to be played, and detect the acoustic waves from the drivers of the speaker 10 via the microphone 54. The software module then determines, based on the detected response from the drivers of the speaker 10, the optimal coefficients for filters in the standing wave room correction module 26 and speaker placement room correction module 28. The determined coefficients are then saved in the storage unit of the DSP 14.

Figure 5:
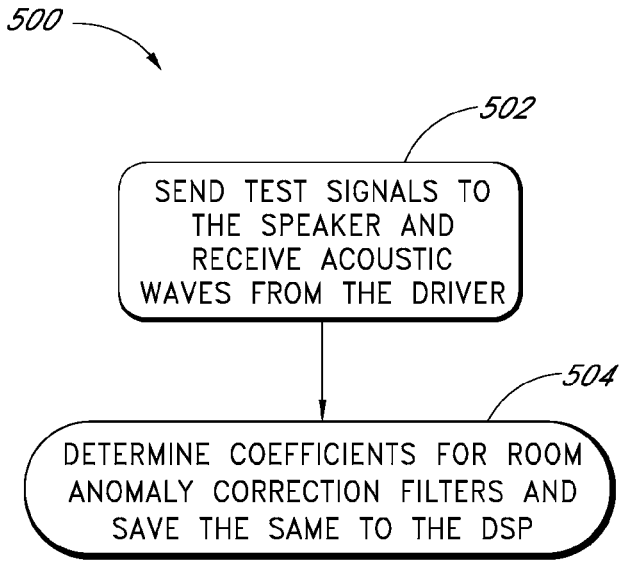
FIG. 5 is a flowchart of one embodiment of a method for configuring the speaker for room correction.

FIG. 5 is a flowchart of one embodiment of a method for configuring the speaker for room correction. Depending on the embodiment, certain steps of the method may be removed, merged together, or rearranged in order. The method may be performed, for example, by a room anomaly correction software module stored in the configuration device 52 in FIG. 3 or the DSP 14 in FIG. 4.

The process 500 starts at block 502, wherein test signals are sent to the drivers of the speaker for playing. As discussed in FIGS. 3 and 4, the test signals may be sent from a configuration device 52 or the DSP 14 of the speaker 10. Measurement of the acoustic waves from the drivers of the speakers is then taken. In one embodiment, the sound of the speaker is measured from the location of a mixing console which provides sound signals to the speaker during its normal operation or a particular listening position. The test signals may be sine wave stimulus in order to collect frequency response data for the speaker 10.

Moving to a block 504, the room anomaly correction module determines the values for the tunable parameters of the standing wave room correction module 26 and the speaker placement room correction module 28 to optimize room anomaly correction for a particular listening or mix position in the room. These values are then stored in the storage unit of the DSP 14 and used by the standing wave room correction module 26 and the speaker placement room correction module 28. In the exemplary embodiment, the tunable parameters are the coefficients for the IIR bi-quad filters in the standing wave room correction module 26 and the parametric shelving filter in the speaker placement room correction module 28.

In the exemplary embodiment, the room anomaly correction module utilizes at least three fully parametric equalizers and a parametric shelf that automatically measure the room modes and sets the correct frequencies, bandwidths, and amounts of cut required to correct for each mode at any position in the room. The room anomaly correction module is able to correct for two or more different positions in the room. The room anomaly correction module takes care of the difference in distances of the speakers to any desired listening position, as well as any level differences.

In the exemplary embodiment, the room anomaly correction module sends test signals to the speaker for playing, receives acoustic waves from the driver, and then determines coefficients for room anomaly correction filters based on the received acoustic waves. The exemplary embodiment may be revised in various ways without leaving the scope of disclosure. In another embodiment, the room anomaly correction module may receive from a user via an input/output interface, information indicative of the room anomalies, such as room dimensions and speaker placement. The room anomaly correction module then determines, based on the information received, coefficients for room anomaly correction filters.

Secondary Reflection Correction

In addition to the room anomaly, speakers' response may also be impaired by another type of effect called secondary reflection. When speakers are placed with a reflective surface, e.g. a mixing console, between them and the listener, a delayed, reflected version of the signal is added into the direct wave in the order of a millisecond or so later. These reflections arrive so fast to a listener that he has no way to decipher it from a direct or reflected wave. The waves simply add and subtract from the instruments recorded sound, destroying the reality of it. It can causes comb filtering, dips in the speaker's frequency response in the critical 800 Hz-3 KHz range. This can cause vocals to recede into the background of a mix. The loss of this definition in vocal articulation can drive a listener to boost these frequencies to compensate. Then when played back in an average listening environment or in another studio with different speaker locations, the response will be overly harsh. These reflections can also have a negative impact on the stereo image. It has been very difficult to correct the secondary reflection by analog electronics or elements because this is a time domain based problem.

In one embodiment, the DSP 14 comprises a secondary reflection correction unit 24 configured to process the audio signals at its input to compensate secondary reflections. In one embodiment, the secondary reflection correction unit 24 comprises one or more finite impulse response filters with inverted band limited impulses canceling early reflections off an object, e.g., those within about few milliseconds.

The secondary reflection correction unit 24 comprises tunable parameters which may be configured during a setup. The tunable parameters may comprise the coefficients for the finite impulse response filters. A system similar to FIGS. 3 and 4 may be used for configuring the secondary reflection correction unit.

Figure 6:
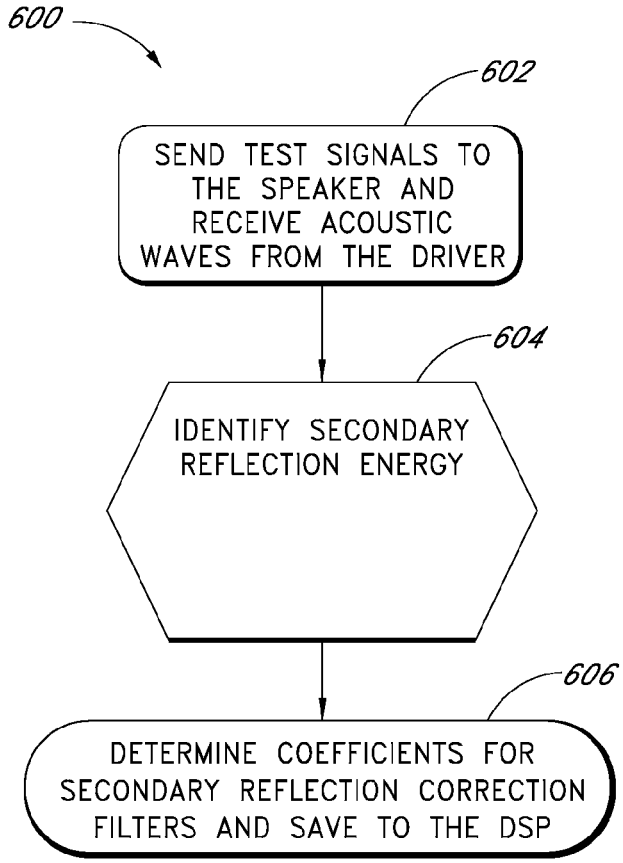
FIG. 6 is a flowchart of one embodiment of a method for configuring a speaker for secondary reflection correction.

FIG. 6 is a flowchart of one embodiment of a method for configuring a speaker for secondary reflection correction. Depending on the embodiment, certain steps of the method may be removed, merged together, or rearranged in order. The method may be performed, for example, by a software module stored in the configuration device 52 in FIG. 3 or the DSP 14 in FIG. 4.

The process 600 starts at block 602, wherein test signals are sent to each speaker in setup and measurement of the acoustic response from the speaker is taken via the microphone 54. The test signals may be test chirp stimulus which is a sine wave with a fast ramp in frequency. In the exemplary embodiment, a known white noise is used as the test signals in order to collect time information data for the speaker.

Moving to a block 604, the secondary reflection correction module identifies secondary reflection energy and cancels it out using convolution algorithms. In the exemplary embodiment, the secondary reflection correction module uses correlations of the acoustic waves from the speaker to identify direct waves and reflected waves. Next to a block 606, coefficients for one or more finite impulse response filters in the secondary reflection correction unit 24 are determined and saved in to the storage unit of the DSP 14.

In the exemplary embodiment, the secondary reflection correction module identifies the exact time and character of each secondary reflection that arrives within a certain time limit and cancels them out by convolving the signal with the opposite or inverted reflections. Therefore, the secondary reflection correction unit 2, after the setup, is configured to remove only the early reflections. This offers a better image than taking away every reflection in the entire room at the location of a listener's head, since it would then sound as if he were in an anechoic chamber, which is a sensory depriving environment that is very disconcerting to a human.

The secondary reflection correction filters 142, after the setup, handles these reflections by adding in a band limited, phase inverted signal into the audio stream of the speaker. This inverted, band limited signal cancels out the reflected signal. This corrects for the comb filtering caused by the summation of a direct wave with the delayed reflection of the same signal. The reason for band limiting the cancellation signal is to provide a larger "sweet spot" where the cancellation signal will be time coherent to the reflected signal. In practice the deepest of the comb filtering resulting from a secondary reflection is in the lower frequencies and typically near the critical 1 KHz area which is very sensitive to imaging and sound presence. Therefore, with a band limited cancellation signal the comb filtering are cancelled in a much larger area of listening positions.

The band limited impulse is applied to cancel out the reflections only below a particular frequency, such as about 3 KHz. As discussed above, sound reflections of a higher frequency do not need to be cancelled since a listener is able to correctly recognize them as reflections. In one embodiment, the configuration device calculates the location and magnitude of the cancellation band limited impulses.

In the exemplary embodiment, the secondary reflection correction module sends test signals to the speaker for playing, receives acoustic waves from the driver, identifies secondary reflection energy and determines coefficients for secondary reflection correction filters based on the received acoustic waves. The exemplary embodiment may be revised in various ways without leaving the scope of disclosure. In another embodiment, the secondary reflection correction module may receive from a user via an input/output interface, information indicative of the secondary reflections, such as measurement of the direct and reflected path lengths. The secondary reflection correction module then determines, based on the information received, coefficients for secondary reflection correction filters.

Manufacturing Anomaly Correction

Certain anomalies are introduced in the process of manufacturing speakers, therefore causing variance in the frequency response of speakers. Such manufacturing anomalies need to be compensated properly to render good performance for each speaker.

In one embodiment, the DSP 14 may comprise a set of driver correction filters for each driver in the speaker 10, which are configured to correct the transfer function of that driver. In the exemplary embodiment, the DSP 14 comprises high-frequency driver correction filters 36 and low-frequency correction filters 46 configured to correct the transfer function of the high-frequency driver 1 and the low-frequency driver 2 respectively. The high-frequency driver correction filters 36 and the low-frequency correction filters 46 may each comprise a bank of N bi-quad IIR filters (in series or parallel), or any other suitable filter types. The driver correction filters 36 and 46 comprise tunable parameters which may be optimized for manufacturing anomaly correction. A system similar to FIGS. 3 and 4 may be used for configuring the driver correction filters 36 and 46 to correct manufacturing anomalies. Though the speaker in the exemplary embodiment comprises two individual speakers, the embodiment is equally applicable to a speaker having any number of speakers.

Figure 7:
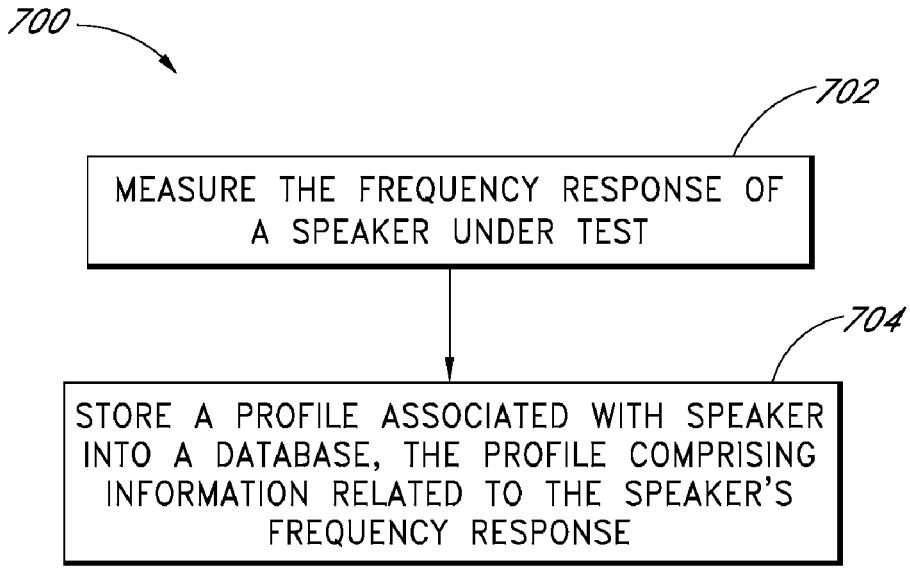
FIG. 7 is a flowchart of one embodiment of a method for measuring and storing the speaker's response.

FIG. 7 is a flowchart of one embodiment of a method for measuring and storing the speaker's response. Depending on the embodiment, certain steps of the method may be removed, merged together, or rearranged in order. The method may be performed, for example, by a manufacturing anomaly correction software module stored in the configuration device 52 in FIG. 3 or the DSP 14 in FIG. 4.

The process 700 starts at block 702, wherein a test is performed to measure the speaker's frequency response. The test may be performed by sending test signals to the speaker for playing and measuring the acoustic response from the speaker via the microphone 54.

Moving to block 704, a profile, associated with the speaker or the drivers included in the speaker, is saved into a database. The profile may comprise the speaker's frequency response or any information related to the frequency response. In one embodiment the frequency response of the speaker is saved in the profile so that later optimal values for coefficients for driver correction filters may be determined based on the frequency response. In another embodiment, the profile may comprise optimal values for coefficients for driver correction filters determined based on the speaker's frequency response.

Once information related to a speaker's frequency response is stored into a database, a method may be performed to configure the speaker for manufacturing anomaly correction based on information saved in the database. The setup for configuring the speaker for manufacturing anomaly correction is similar to the setup in FIGS. 3 and 4, except that the microphone 54 is now not necessary.

Figure 8:
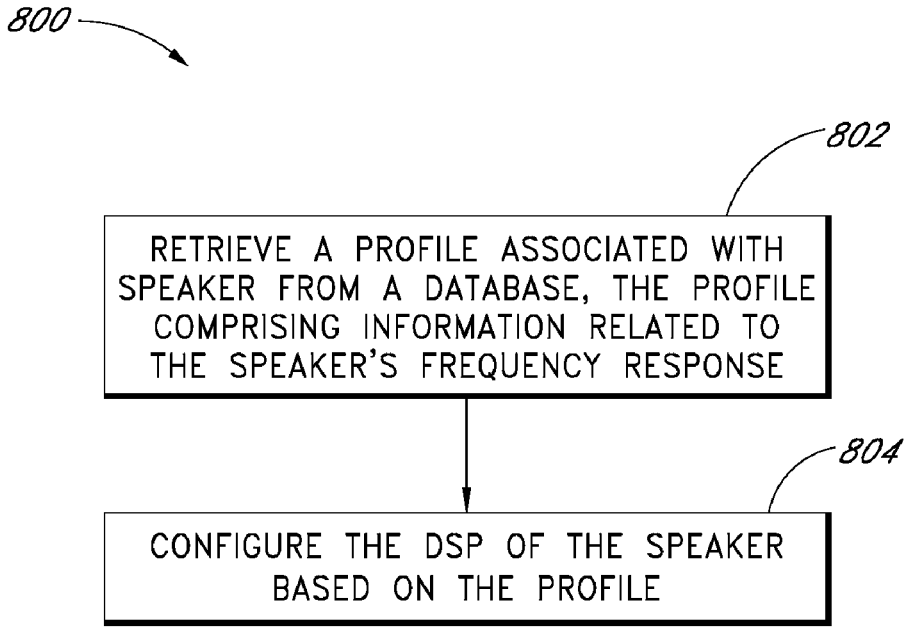
FIG. 8 is a flowchart of one embodiment of a method for configuring a speaker to correct manufacturing anomalies.

FIG. 8 is a flowchart of one embodiment of a method for configuring a speaker to correct manufacturing anomalies. Depending on the embodiment, certain steps of the method may be removed, merged together, or rearranged in order. The method may be performed, for example, by a manufacturing anomaly correction software module stored in the configuration device 52 in FIG. 3 or the DSP 14 in FIG. 4.

The process 800 starts at block 802, where a profile comprising information related to a speaker's frequency response is retrieved from a database. Moving to block 804, the DSP 14 is configured based on the profile retrieved to compensate manufacturing anomalies. The optimal values for coefficients for driver correction filters 36 and 46 are determined based on information retrieved from the database. The optimal values are then saved into the storage unit of the DSP 14 and used by the driver correction filters 36 and 46 thereafter.

In one embodiment the frequency response of the speaker is included in the profile and optimal values for coefficients for driver correction filters 36 and 46 may be determined based on the frequency response. In another embodiment, the profile may comprise optimal values for coefficients for driver correction filters 36 and 46.

In the exemplary embodiment, the database may be any suitable way of storing the profile and associating the profile with the speaker. In one embodiment, the location where the speaker is configured is remote from the location where the speaker is tested.

The profile in the database may be accessed by various mechanisms and via remote connection or local connection. For example, the profile may be retrieved from the database and then shipped via internet or a computer-readable medium to the location where the speaker is being configured. In another example, the profile may be retrieved by accessing the database via network or internet.

The methods in FIGS. 7 and 8 may be applied to many applications. In one exemplary application, drivers of a speaker A in the field, e.g. used by a customer, may stop working properly. In that case, drivers from a speaker B of the same type as the speaker A may be used to replace the broken drivers in the speaker A. Since the drivers of the speaker B have different frequency responses from the drivers of the speaker A, the DSP of the speaker A needs to be configured to compensate for any manufacturing anomalies in the new drivers. This is done by reprogramming the DSP based on the profile storing information related to the frequency response of the speaker B.

In one embodiment, a profile is saved for each of the speakers A and B in the same environment, for example, at the location where these speakers are manufactured.

In one embodiment, the profile is retrieved by the technician via the network using the speaker's identification number or serial number. For example, a radio frequency identification (RFID) chip may be attached to the drivers of the speaker to store the driver or speaker's identification number or serial number.

In another embodiment, a computer-readable medium or a document comprising information related to the frequency response of the speaker is shipped together with the speaker B. The technician may simply open the package for speaker B to get the profile.

A Coaxial Speaker With a Digital Signal Processor

Figure 9:
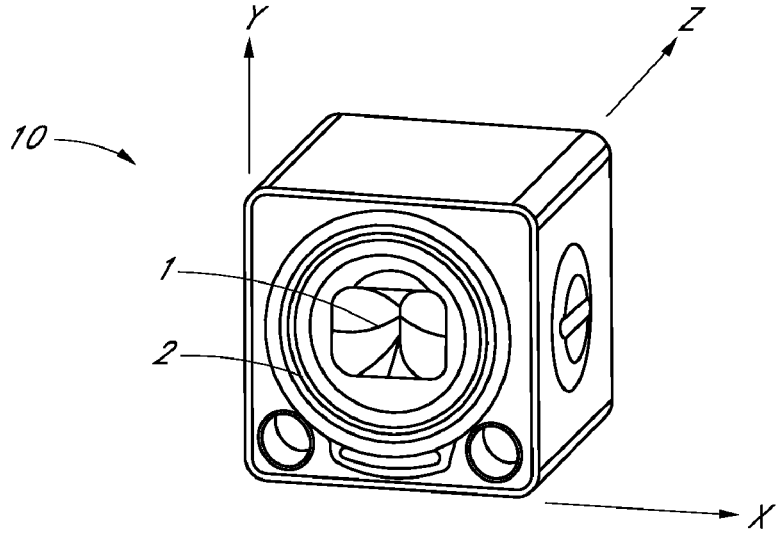
FIG. 9 is a perspective diagram showing one embodiment of a coaxial speaker.

In one embodiment, the speaker 10 as described in FIG. 1 is configured as a co-axial speaker. FIG. 9 is a perspective diagram showing one embodiment of a coaxial speaker. A coaxial speaker usually refers to a speaker system in which the individual drivers radiate sound approximately from the same point or axis. In FIG. 9, this is achieved by placing the high-frequency driver 1 in the center of the low-frequency driver 2. As shown, the high-frequency driver 1 and the low-frequency driver 2 are at the same location along X axis and Y axis (which later may be referred to as horizontal axis and vertical axis respectively), but at different locations along Z axis.

Figure 10:
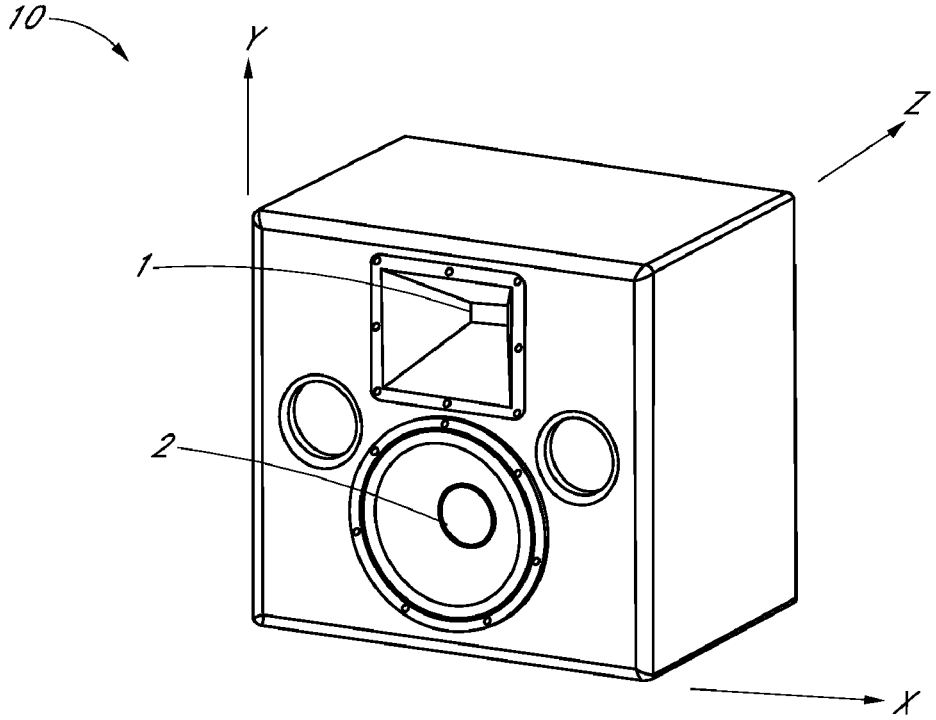
FIG. 10 shows an exemplary non-coaxial speaker.

FIG. 10 shows an exemplary non-coaxial speaker. The non-coaxial speaker is different from the coaxial speaker in FIG. 1 in that the high-frequency driver 1 of the speaker 12 is above the low-frequency driver 2. As shown, the high-frequency driver 1 and the low-frequency driver 2 are at the same location along X axis and Z axis, but at different locations along Y axis.

A coaxial speaker has many advantages over a non-coaxial speaker, one of which is described as follows. The directional and power response characteristics related to how a speaker distributes sound into the room are largely determined by the driver placement on a baffle. If the drivers are aligned vertically on the speaker baffle, the vertical frequency response coverage patterns exhibit cancellations above and below the on-axis location. These cancellations occur throughout the crossover frequency range, i.e., the frequency range that both the high-frequency driver and the low-frequency driver provide, resulting in an uneven vertical coverage pattern.

Speaker crossovers are designed with the measurement microphone on axis with the speaker, usually positioned on the high-frequency driver or between the high-frequency and low-frequency drivers. As the microphone is moved above and below the on-axis location, the distances from each driver to the microphone location become different. Since the driver's are producing some of the same frequency information, the energy from the drivers cancels each other as it arrives at the microphone. This occurs because the energy arrives at different times from the drivers to the microphone and not in phase with each other. This cancellation is known as lobbing. The effects of lobbing occur predominately when two drivers are reproducing the same frequencies but the energy from these sources is not in sync. This same situation occurs when the speaker is used in its application except the microphone is replaced by a listener's ears.

In a typical speaker having a woofer and a tweeter, the woofer and tweeter drivers each produce primarily lows and highs respectively except in the crossover frequency range where there is significant overlap of the frequencies produced right in the critical 800 Hz to 3 KHz region, which dramatically affects how well vocals and other instruments are recreated and imaged in the space between and around your speakers. It is in this frequency range where the smooth off-axis benefits of a well designed coaxial driver speaker and the lobbing off-axis disadvantages of a non-coaxial driver speaker are most audible.

For a non-coaxial speaker, there are substantial frequency responses cancellations since the centers of the two drivers are not aligned along the Y axis. A co-axial speaker has the centers of the two drivers aligned along the X and Y axis, thus producing smooth off-axis frequency response without any aberrations or lobbing anomalies. The coaxial speaker eliminates lobbing in the crossover frequency region because it aligns the drivers so they share the same axis.

Point Source Confusion

Speakers with separate vertically mounted high-frequency and low-frequency drivers also suffer in the near field monitoring position from what is called "point source confusion". With instruments that produce energy on both sides of the crossover, a listener in the near field will have a tendency to look up and down repeatedly between the high-frequency and low-frequency driver planes searching for the true source of the sound. This destroys the image in the near field. A true coherent point source does not suffer from "point source confusion". In the near field the sound image will always be well defined and positioned at the true mix location. The sound will appear to come from between the drivers and not from each driver.

The term point-source is often used to describe the optimum sound source. The advantage being that sound from a point source comes from one location so all the sound starts from the same place and time and emits together from the source in phase resulting in a coherent sound wave.

Although coaxial drivers are aligned in both the vertically and horizontally axis, they are not typically aligned in the Z axis for various mechanical reasons depending on the high-frequency driver configuration. Some existing systems use passive crossover techniques to adjust the time delay between the two drivers along the Z axis. However, these passive crossover techniques are limited to power input and contributed undesirable harmonic distortion and phase anomalies at high power levels. Also, typically, these passive crossover techniques can only correct the time delay at a single frequency. For other frequencies within the crossover frequency range, the time delay is not adjusted properly.

In one embodiment, the DSP 14 comprises hi-pass crossover filters 34 and low-pass crossover filters 44 (see FIG. 6) configured to divide the audio signals into different frequency ranges. The DSP 14 further comprises a high-frequency time delay correction unit 38 and a low-frequency time delay correction unit 48 configured to introduce appropriate time delay so that sound from the high-frequency driver 1 and the low-frequency driver 2 arrives at a listener at the same time. In one embodiment, the time delay introduced is independent of the frequency of the signal. Also, the high-frequency time delay correction unit 38 and the low-frequency time delay correction unit 48 may be further configured to correct different path lengths for alternate listening positions.

The high-frequency time delay correction unit 38 and the low-frequency time delay correction unit 48 thus line up the acoustic wave fronts of the high frequency driver land the low-frequency driver 2, offering better control on how the waves sum up in the crossover frequency region and achieving more of a point source action. The acoustic centers of the high-frequency driver 1 and low-frequency driver 2 (see FIG. 1) are aligned along the z-axis electronically in the crossover frequency range to make the speaker a true point-source speaker, which does not suffer from "point source confusion". In one embodiment, the time delay correction units are capable of aligning the acoustic centers of the high-frequency driver 1 and low-frequency driver 2 along the z-axis for multiple frequencies within the crossover frequency range.

In one embodiment, the DSP 14 may further comprise a set of driver correction filters for each driver in the speaker 10, which are configured to correct the transfer function of that driver by removing singularities in the transfer function, which cause deviations in both the frequency response as well as the phase response of the driver. The transfer function is a mathematical representation of the relation between the output and the input of a system.

In the exemplary embodiment, the DSP 14 comprises high-frequency driver correction filters 36 and low-frequency correction filters 46 configured to correct the transfer function of the high-frequency driver 1 and the low-frequency driver 2 respectively. The high-frequency driver correction filters 36 and the low-frequency correction filters 46 may each comprise a bank of N bi-quad infinite impulse response (IIR) filters (in series or parallel), or any other suitable filter types.

Correcting Anomaly Introduced By a Horn

In one embodiment, the high-frequency driver 1 comprises a horn combined with a compression driver (not shown). The horn may be, for example, exponential horn. When combined together with a compression driver and the proper equalizer response, horns offer substantially reduced distortion levels, especially when compared to direct radiator type high-frequency drivers producing the same sound pressure levels.

However, horns typically do not provide a flat, smooth response. They are limited in their low frequency ability by their length and size of mouth. Their high frequencies are limited by either the throat geometry (for pattern control) or the mass of the diaphragm or by the physical distances internal to the compression driver itself. At these two extremes, control of the diaphragm is lost and between these frequencies the horn excels increasingly at producing low distortion energy at higher sound power level, creating a hump shaped frequency response curve. The response of horns may be characterized by its transfer function.

Horn's transfer function includes poles and zeros, both of which are singularities of the transfer function. The location of the poles and zeros causes the bumps and dips in the frequency response of horns. It is virtually impossible to cancel these poles and zeros using passive components or even active analog electronics without individually hand selecting components for highly elaborate analog filters.

In one embodiment, The DSP 14 may comprise a set of driver correction filters for each driver in the speaker 10, which are configured to correct the transfer function of that driver. In the exemplary embodiment, the DSP 14 comprises high-frequency driver correction filters 36 and low-frequency correction filters 46 configured to correct the transfer function of the high-frequency driver 1 and the low-frequency driver 2 respectively. The high-frequency driver correction filters 36 and the low-frequency correction filters 46 may each comprise a bank of N bi-quad IIR filters (in series or parallel), or any other suitable filter types.

The high-frequency driver correction filters 36 is capable of calculating the opposite of these poles and zeros in the transfer function of the horn and then eliminate these poles and zeros. In the exemplary embodiment, the process of eliminating these poles and zeros are approximated by cutting away unwanted energy as a first pass and then minimally filling in areas to achieve a smooth frequency response.

In one embodiment, the high-frequency driver correction filters 36 are recursive, because the mechanical transfer function of the driver is recursive, containing both zeros and poles, which induce phase variations that need to be cancelled. In comparison, linear phase filters can only correct amplitude.

The DSP 14 may also comprise a high-frequency time delay correction unit 38 and a low-frequency time delay correction unit 48 configured to align the acoustic centers of the horn and the low-frequency driver 2 determined in part by their physical spacing dimensions. Delay is added to the low-frequency driver 2 so the horn and compression driver combination could align acoustically to achieve a detailed point source.

In the embodiments, a secondary reflection correction module and a room anomaly correction module are described. It should be noted that these two modules may be integrated together. Further, these modules may further include an interactive computer GUI system that works hand in hand with the speaker's onboard DSP system. This GUI program tests the environment and sets the DSP's filters and SRC coefficients in one setup.

There are certain benefits of the foregoing embodiments. Firstly, one embodiment is based on a coaxial speaker driver to maintain as close to a true point source as possible. Second, the DSP connected to the speaker provides the ability to line up the acoustic wave fronts of the high frequency driver unit and the low frequency driver unit. This ability to line up acoustic wave fronts of two drivers built around the same axis offers more control on how the waves will sum up in the crossover region and help achieve more of a point source action.

Third, to achieve higher sound pressure levels than the industry standard soft dome tweeters can obtain, one embodiment uses true compression drivers and a coaxial horn. In one embodiment, the horn is a constant directivity horn. The DSP helps overcome the downside to using a horn which is the poor frequency response. Horns in coaxial driver designs are typically too small and this results in operation of the horn too close to the horn cutoff frequency. When running a horn close to cutoff the frequency response typically has a large rise in energy near cutoff and other deviations from the desired flat response. The DSP corrects these anomalies and enable use of the horn across a much wider frequency range than in traditionally designs.

Further, the DSP cancels out the effects of near field reflections. These reflections radiate off of object near the speakers or near the listening position. Mixing consoles, control surfaces, desks, and video monitors are typical sources of these near field or secondary reflections. The secondary reflection correction unit in the DSP takes care of these reflections by adding in a band limited, phase inverted signal into the audio stream of the speakers. This inverted, band limited signal cancels out the reflected signal. This corrects for the comb filtering caused by the summation of a direct wave with the delayed reflection of the same signal. The reason for band limiting the cancellation signal is to provide a larger "sweet spot" where the cancellation signal will be time coherent to the reflected signal. In practice the deepest of the comb filtering resulting from a secondary reflection is in the lower frequencies and typically near the critical 1 KHz area which is very sensitive to imaging and sound presence. Therefore, with a band limited cancellation signal the comb filtering are cancelled in a much larger area of listening positions.

Certain features of one exemplary embodiment of the speaker are summarized as follows.

- 24-bit/96 KHz, 28-bit coefficients Guarantees high resolution for accurate frequency response equalization at all frequencies.
- Dual Threshold Compressor/Limiters with side chain processing per driver. With side chain processing, the limiters may have different sensitivities for different frequencies.
- Enabling you to set multi-band limiters with optional soft knee or noise gating.
- Precise crossovers designed by importing response data of each individual driver separately and then applying correction to each driver, taking into account driver acoustic delays, magnitude and phase information.

The foregoing description details certain embodiments of the invention. It will be appreciated, however, that no matter how detailed the foregoing appears in text, the invention may be practiced in many ways. It should be noted that the use of particular terminology when describing certain features or aspects of the invention should not be taken to imply that the terminology is being re-defined herein to be restricted to including any specific characteristics of the features or aspects of the invention with which that terminology is associated.

While the above detailed description has shown, described, and pointed out novel features of the invention as applied to various embodiments, it will be understood that various omissions, substitutions, and changes in the form and details of the device or process illustrated may be made by those skilled in the technology without departing from the spirit of the invention. The scope of the invention is indicated by the appended claims rather than by the foregoing description. All changes which come within the meaning and range of equivalency of the claims are to be embraced within their scope.

What is claimed is:

1. A method of configuring a speaker in a room to compensate for secondary reflections off an object in the room, the speaker comprising a digital signal processor which comprises tunable secondary reflection correction filters, the method comprising:

identifying secondary reflections off an object in the room where the speaker is located;

generating secondary reflection correction coefficients to cancel secondary reflections arriving within a particular time limit; and saving the generated coefficients into the digital signal processor to configure the secondary reflection correction filters.

2. The method of claim 1 further comprising:

sending a test audio signal to the speaker; and measuring the sound of the speaker, wherein the identifying of secondary reflections is based on the measured sound.

3. The method of claim 1 further comprising receiving information indicative of secondary reflections, wherein the identifying of secondary reflections is based on the received information.

4. The method of claim 3, wherein the information received comprises measurement of direct and reflected path lengths.

5. A device for configuring a speaker in a room to compensate for secondary reflections off an object in the room, the speaker comprising a digital signal processor which comprises tunable secondary reflection correction filters, the device comprising:

a storage unit having stored therein a software module; and a control unit configured to perform the software module configured to:

identify secondary reflections off an object in the room where the speaker is located;

generate secondary reflection correction coefficients to cancel secondary reflections arriving within a particular time limit; and store the generated coefficients into the digital signal processor to configure the secondary reflection correction filters.

6. A method of configuring a speaker to compensate for manufacturing tolerances, the speaker comprising a digital signal processor having a tunable manufacturing correction filter, the method comprising:

at a first location, sending a test audio signal to the speaker, measuring a frequency response of the speaker via a microphone; and storing a profile associated with the speaker, the profile comprising information related to the measured frequency response;

at a second location remote from the first location, retrieving the stored profile; and configuring the manufacturing correction filter of the speaker to compensate for the manufacturing tolerances based on the retrieved profile.

7. A method of configuring a speaker to correct for manufacturing tolerances, the speaker comprising a digital signal processor having tunable manufacturing correction filters, the method comprising:

retrieving a profile associated with the speaker, the profile comprising information related to a frequency response of the speaker, the frequency response being measured at a first location, the profile being retrieved at a second location remote from the first location; and configuring, at the second location, the manufacturing correction filters of the speaker to compensate for the manufacturing tolerances based on the retrieved profile.

8. A device for configuring a speaker to correct for manufacturing tolerances, the speaker comprising a digital signal processor having tunable manufacturing correction filters, comprising:

a storage unit having stored therein a software module; and a control unit configured to perform the software module configured to:

retrieve a profile associated with the speaker, the profile comprising information related to a frequency response of the speaker, the frequency response being measured at a first location, the profile being retrieved at a second location remote from the first location; and configure, at the second location, the manufacturing correction filters of the speaker to compensate for the manufacturing tolerances based on the retrieved profile.

9. A method of configuring a speaker to correct for manufacturing tolerances, the method comprising:

measuring a frequency response of a speaker at a first location;

storing at the first location a profile comprising information related to the measured frequency response of the speaker;

delivering the stored profile to a second location remote from the first location; and configuring the speaker to correct for manufacturing tolerances based on the stored profile at the second location.

10. The method of claim 2, wherein the test audio signal comprises test chirp stimulus.

11. The method of claim 2, wherein the test audio signal comprises a white noise.

12. The method of claim 1, wherein the particular time limit is in the order of milliseconds.

13. The method of claim 1, wherein the secondary reflection correction filters comprise finite impulse response filters.

14. The method of claim 13, wherein the finite impulse response filters have inverted band limited impulses.

15. The method of claim 1, wherein identifying secondary reflections comprises using correlations of an acoustic response from the speaker to identify direct waves and reflected waves.

16. The method of claim 1, wherein secondary reflections are cancelled by convolving each secondary reflection arriving within a particular time limit with an opposite or inverted reflection.

17. The method of claim 7, wherein the profile comprises the measured frequency response of the speaker.

18. The method of claim 7, wherein the profile comprises optimal values of coefficients for the manufacturing correction filters of the speaker determined based on the frequency response of the speaker.

19. The method of claim 7, wherein the manufacturing correction filters comprise finite impulse response filters.

20. The method of claim 7, wherein the manufacturing anomaly correction filters comprise bi-quad finite impulse response filters.

21. The device of claim 8, wherein the profile comprises the measured frequency response of the speaker.

22. The device of claim 8, wherein the profile comprises optimal values of coefficients for the manufacturing correction filters of the speaker determined based on the measured frequency response of the speaker.

23. The device of claim 8, wherein the manufacturing correction filters comprise finite impulse response filters.

24. The device of claim 8, wherein the manufacturing correction filters comprise bi-quad finite impulse response filters.

* * * * *